United States Patent [19]

Thomas et al.

[11] 4,314,612

[45] Feb. 9, 1982

[54] HYDRAULIC LINEAR IMPACT TOOL

[75] Inventors: David L. Thomas; Donald J. Hackman, both of Columbus, Ohio

[73] Assignee: Battelle Development Corporation, Columbus, Ohio

[21] Appl. No.: 926,305

[22] Filed: Jul. 20, 1978

[51] Int. Cl.[3] ..... B25D 9/18

[52] U.S. Cl. ..... 173/119; 91/291

[58] Field of Search ..... 91/468, 291, 330; 173/119, 135, 138

[56] References Cited

U.S. PATENT DOCUMENTS

| | | | |
|---|---|---|---|
| 1,598,426 | 8/1926 | Ditson . | |
| 2,069,122 | 1/1937 | Weaver | 91/291 |
| 2,113,161 | 4/1938 | Osborne . | |
| 2,978,044 | 4/1961 | Baines | 117/119 X |
| 3,322,038 | 5/1967 | Dobson . | |
| 3,599,731 | 8/1971 | Lawlis | 173/119 |
| 3,971,448 | 7/1976 | Grover et al. . | |
| 4,026,193 | 5/1977 | Olmsted . | |
| 4,034,817 | 7/1977 | Okada . | |
| 4,082,032 | 4/1978 | Swenson | 91/330 |

FOREIGN PATENT DOCUMENTS

| | | | |
|---|---|---|---|
| 1209489 | 10/1970 | United Kingdom | 173/135 |
| 231478 | 3/1969 | U.S.S.R. | 173/119 |
| 481696 | 4/1978 | U.S.S.R. | 173/119 |

*Primary Examiner*—Werner H. Schroeder
*Assistant Examiner*—Andrew M. Falik
*Attorney, Agent, or Firm*—Barry S. Bissell

[57] ABSTRACT

A hydraulically operated impact tool is provided for performing land-based or undersea tasks including hammering, chipping, scraping, punching, and cutting. The tool's features include a spring (preferably hydroelastic) for storing impact-stroke energy, a configuration of valves which eliminates flow in the supply and return lines during the impact stroke, and a control approach which provides operator selection of either single-blow or continuous-cycling operation.

5 Claims, 10 Drawing Figures

AT REST

RETURN
INTERMEDIATE
SUPPLY
GREATER THAN SUPPLY

RETURN
INTERMEDIATE
SUPPLY
GREATER THAN SUPPLY

HYDRAULIC LINEAR IMPACT TOOL

The Government has rights in this invention pursuant to Contract No. N00024-75-C-4176 awarded by the U.S. Navy. Impact tools for tamping, breaking and cutting are known in the art and have been variously designed to employ three power systems—hydraulic, pneumatic and electric. The advantages of each are well reported and each suffers some disabilities.

BACKGROUND OF THE INVENTION

The present invention is a hydraulic linear impact tool which does not employ the accumulators normally used in the past (e.g. U.S. Pat. No. 3,971,448). During the impact stroke, there is no flow of fluid in the supply and return lines as is the case with devices which use accumulators. This is important in that the impact speed (force) and frequency of impacts are effected, in the devices employing accumulators, by the size of the supply and return lines. The lines are also subject to high pressure excursions which can cause damage. In the present invention, impact speed is not affected by supply and return line size because no flow of fluid occurs therein during the impact stroke.

SUMMARY OF THE INVENTION

It is an object of the present invention to provide a hydraulic impact tool which is useable on land and undersea.

It is also an objective to provide such a tool wherein the length or diameter of the lines connecting the linear impact tool with the hydraulic power supply does not significantly influence the impact velocity and thus the energy per blow.

It is further an objective that the linear impact tool will deliver single or repetitive high-energy blows at the discretion of the operator.

It is likewise an object of the invention that the compressibility of hydraulic fluid be utilized as a spring so that mechanical spring failure due to impact-induced surges cannot be a problem.

A further object of the invention is to provide a tool which is protected against internal damage by a snubbing chamber for situations in which the striker impact energy is not delivered to a tool bit.

The present invention is a hydraulically-operated linear impact device having a body member and a longitudinal striker or plunger bore extending therethrough with a plunger or striker supported in the bore, a main valve, a trigger valve, hydraulic fluid lines connecting the plunger and valves with a source of hydraulic fluid, a spring acting near the upper end of said piston and means for detachably mounting a tool member at the lower end of said body member. The trigger valve is mounted in the body member for movement between an actuating position and a rest position and the plunger is supported for reciprocating movement in the bore between a first position in which the plunger compresses the spring at the upper end of the body member and a second position at the lower end of the body member in which the plunger piston may impact the tool member. The plunger has an enlarged diameter area intermediate its upper and lower ends forming a valved annular work surface for hydraulic fluid pressure acting to move the plunger upward against the spring.

The main valve has connections to the plunger bore and to the trigger valve and to a high-pressure supply line and a lower-pressure return line for hydraulic fluid and is positionable, when the trigger is in actuating position, in response to the condition of the plunger such that when the plunger is in its downward second position the main valve connects supply pressure with the valved annular area of the plunger to cause the plunger to reverse direction and be moved upward against the spring, and when the plunger has moved to its uppermost first position against the spring, the main valve connects the valved annular surface to return pressure such that the spring is unopposed by supply pressure and can then move the plunger downward on the impact stroke. The hydraulic fluid lines are operable with the trigger is in the actuating position and the plunger is in its downward second position to provide a first fluid circuit from the high-pressure supply line to the main valve for actuating the main valve to connect supply pressure to the valved annular surface and causing the plunger to be moved upward to compress the spring. When the plunger is in its upward first position, the hydraulic fluid lines provide a second fluid circuit from the lower-pressure return line to the main valve for actuating the main valve to connect return pressure to the valved annular surface causing the plunger to be moved downward to impact the tool member due to the compressed spring acting on the plunger.

The spring may comprise a mechanical, pneumatic or hydraulic spring which acts near the upper end of the plunger. Preferably the spring is hydraulic and acts on a spring annular area formed by a second enlarged diameter on the plunger.

The impact device preferably employs an additional pilot valve for sensing the condition of the plunger and controlling the position of the main valve. The said pilot valve is mounted for movement between first and second positions in response to the position of the plunger, such that when the trigger valve is actuated and the plunger is in its downward second position the pilot valve, in its second position, positions the main valve to cause the plunger to be moved upward against the spring, and when the plunger is in its upward, first position against the spring, the pilot valve, in its first position, positions the main valve to allow the plunger to move in its downward impact stroke.

The impact device is adjustable for striking single blows or continuous blows with a mode selector associated with the pilot value. In a first mode, the mode selector allows continuous operation and in a second mode, it allows single blow operation wherein the mode selector temporarily holds the pilot valve in its downward second position which, upon actuation of said trigger valve, positions the main valve to cause the piston to be moved upward against said spring, and when the trigger valve is released to return to its unactuated position, the pilot valve allows the main valve to change positions and cause the plunger to move in its downward impact stroke.

One of the main advantages of the impact device is that the return lines need not be large nor able to withstand pressure surges which are common on prior devices. The reason for this advantage is that fluid from the valued annular area which is biased upward on the cocking stroke by the fluid, is able to be circled through the main valve to a space near the return annular area of the plunger instead of being returned through the return line. During the impact stroke, the main valve is in a position to allow connection of the main supply port serving the valved annular area and the main return port servicing the return annular area.

The tool is useful and improved even if the fluid is returned from the valved annulus to the return line; however, the design of the main valve and the return annulus is the preferred design of the inventive tool since it provides fast, efficient operation with small supply and return lines.

DETAILED DESCRIPTION OF THE INVENTION

Figure 1:
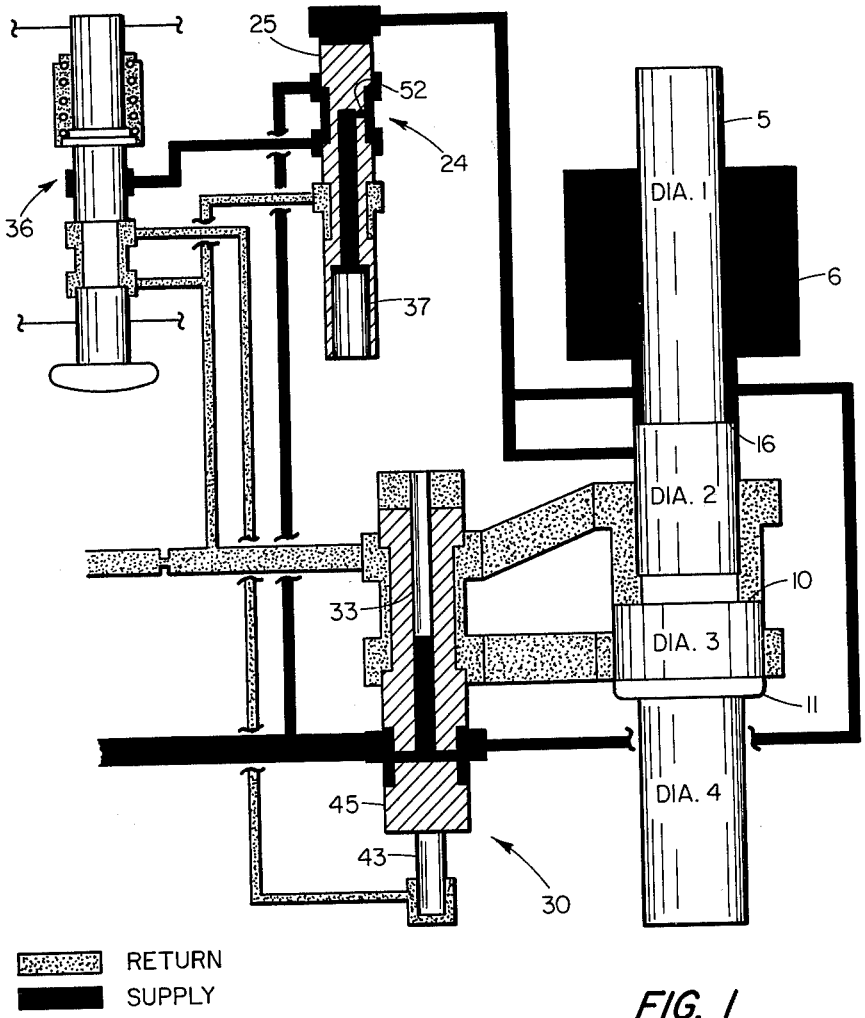
FIG. 1 is a schematic drawing of a preferred embodiment of the hydraulic impact device showing the piston, valve combination and trigger in the rest or no action position.

The linear impact tool design is shown in FIGS. 6–10. The tool consists of two major housings 1 and 2, a handle 3 included for ease of handling, a tool bit retention means 21, and a trigger assembly 4. The striker housing 1 and control valves housing 2 are bolted together on a diagonal parting line. The common surface between the housings has hydraulic interconnections that are sealed with O-rings.

The striker housing 1 contains the plunger or striker 5, the spring chamber 6, and the stepped striker bore 9 containing the striker 5. "O"-ring seals 7 are used in conventional fashion as static seals to separate hydraulic fluid chambers and to seal internal parts from the environment. "T" cross section seals 50 are used as dynamic seals for the striker to separate hydraulic fluid chambers and seal internal parts from the environment. Since there are close clearances between the striker and the mating parts at the diameters where sealing occurs, the parts are designed for ease in maintaining concentricity during fabrication. The closure piece 8 at the spring cavity encloses the external nonimpacting end of the striker throughout its travel.

The striker housing 1, stepped striker bore 9 and spring chamber 6 have annular grooves and passages for connections to the striker valved annulus 11 and return annulus 10 and for supply pressure and the pilot valve control porting at the striker. The main supply port 31 and main return port 32, that accommodate flow between the striker 5 and main valve 30, are large because the flow rate is quite high as the striker approaches impact velocity.

The high pressures developed in storing energy in the present device are contained within a single rugged housing defining the spring chamber 6. The threaded member 12 retains the seal gland 13 and couples pressure loads into the spring chamber housing. The tubular spacer 14 in the spring chamber, (1) retains the two chamber reciprocating seals 50 and the combination of 26 and 27, (2) positions the seal gland 13, (3) has ports 15 for hydraulic fluid flow due to displacement caused by the striker spring annulus 16 during striker motion, and (4) contains holes 51 at the lower extreme for venting air from the spring cavity. Trapped air (which would seriously alter tool performance) will quickly leave the spring chamber if normal operating pressures are applied and the tool is aligned with the striker vertical and the spring cavity down.

Figure 9:
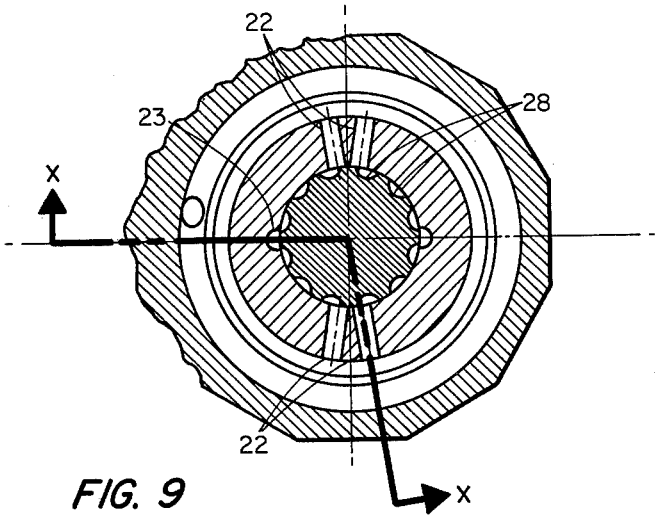
FIG. 9 is a top section view along line DD in FIG. 10 of the sealing and porting arrangement employed between the spring chamber and the pilot valve ports at Diameter 2 of the piston in either the preferred embodiment shown in FIGS. 1–3 or the alternative device shown in FIGS. 4 and 5.
Figure 10:
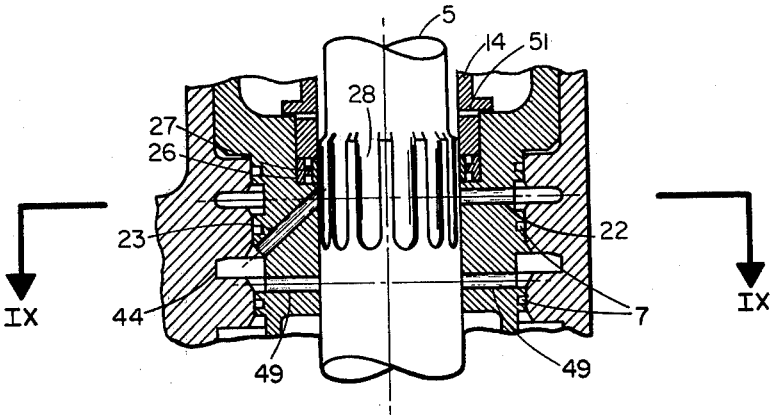
FIG. 10 is a transverse cross-section of the device shown in FIG. 9 along line CC showing the ports and seals on Diameter 2 of the piston.

An unusual multifunction sealing and porting arrangement is employed between the spring chamber and the pilot valve ports. This arrangement provides the valving and sealing functions for the spring chamber and the valving function for the pilot valve. In the cross-sectional views shown in FIGS. 9 and 10, the four radial supply pressure ports 22 are connected to supply pressure. Two radial pilot valve ports 49 and two diagonal pilot valve ports 23 are interconnected and communicate with one end of the pilot-valve spool 25 of pilot valve 24 through pilot valve line 44. The spring-chamber seal consists of the "T" cross-section seal 26 that contacts the O.D. of a special sealing sleeve 27. The striker 5 has flutes 28 cut axially in the perimeter to support the seal sleeve and provide valving. With the striker positioned as shown in FIG. 10, the striker flutes connect supply pressure to the spring chamber and the end of the pilot valve spool 25. As the striker moves upward, the striker closes the ports 22 and 23, trapping hydraulic fluid in the pilot-valve passages and in the spring chamber. Since the fluid volume of the spring chamber decreases as the striker moves upward in FIG. 10, the chamber pressure increases. The seal sleeve 27 supports the "T"-shaped elastomeric seal 26 to prevent damage as the transition between the flutes 28 and a full diameter occurs. The flutes support the seal sleeve and also cause some spring-chamber fluid mixing and exchange each automatic cycle as supply-pressure fluid shifts the pilot valve.

Figure 7:
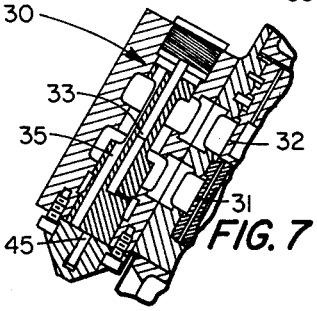
FIG. 7 is a section view along line AA in FIG. 6 showing the main valve configuration.

The control valves housing 2 contains the main, pilot, and trigger valves, ports for external connections, and interconnecting drilled passages. The main valve 30, as best seen in FIG. 7, is configured to have minimum size and to accommodate the low flow rate during the cocking stroke and the very high flow rate during the impact stroke. The small plunger 33 which urges the main valve spool 45 in one direction is incorporated within the spool. Four full-length axial holes 35 allow rapid shifting of the main valve spool.

Figure 8:
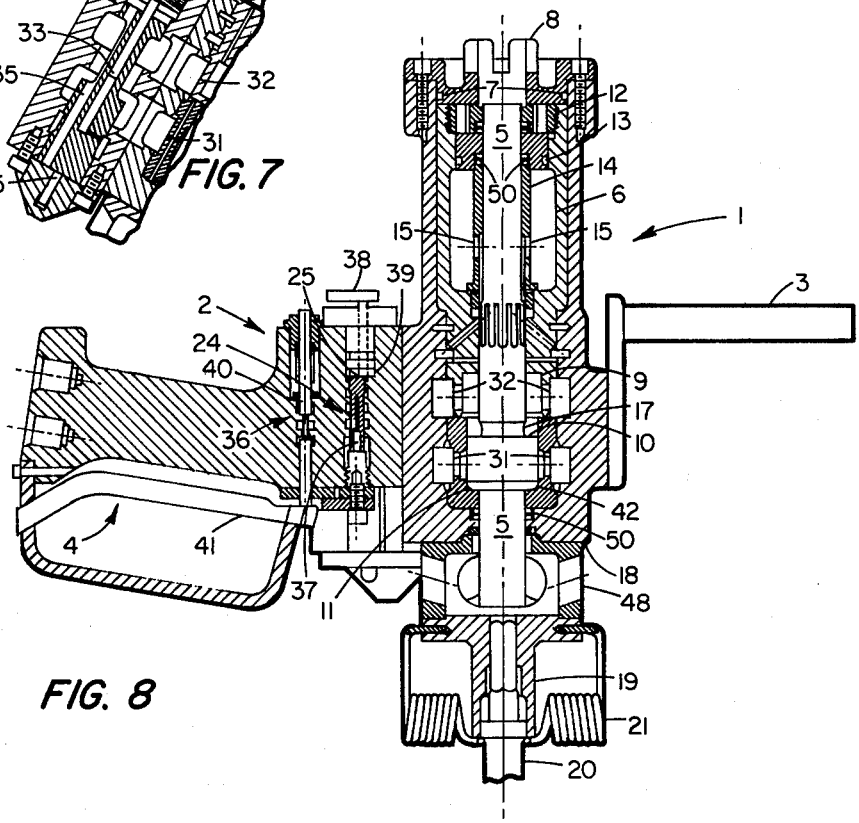
FIG. 8 is a front section view along line BB in FIG. 6 showing the internals of the device.

Both the pilot valve 24 and trigger valve 36 may be small diameter because of the low flow rate they handle. The pilot valve spool 25 incorporates the constant force plunger 37 which urges the spool in one direction. An orifice 52 in the spool between the plunger 37 and the supply pressure annulus of the spool, as best seen in FIGS. 1 to 5, limits the shift speed. The detented two-position mode selector 38 has a tang 39 which is rotated into position to block pilot valve motion for single blow operation. The position shown in FIGS. 6 and 8 is for continuous cycling operation as long as the trigger is depressed.

The trigger-valve spool 40 is spring loaded to the off (or rest) position so the trigger 41 moves the valve against the spring force to actuate the tool. The trigger-valve spool 40 is preferable exposed to the environment at each end for pressure balance.

The tool bits selected for the linear impact tool are commercially available in a variety of point configurations for pneumatic hammers. The tool bits have a hexagonal shank and an oval shoulder. The tool bit chuck 19 has a hexagonal socket to allow bit insertion in any one of six angular positions. The chuck provides axial constraint so the bit is (1) positioned at the proper impact point, (2) retained from falling out of the chuck, and (3) provided free travel in excess of striker motion. The chuck 19 is mounted on impact chamber housing 18 having openings 48 to provide free flow of air or seawater so as to minimize fluid resistance to striker movement and maximize impact velocity.

A snubbing chamber 42 is formed in the piston bore such that hydraulic fluid is trapped in the snubbing chamber by the valved annulus 11 of the striker to absorb the striker energy at the end of the impact stroke if the striker travels past the normal impact position. The outside diameter of the striker is tapered so an annular orifice which decreases in area with over travel is formed to maximize the snubbing pressure throughout the snubbing stroke.

The materials used in the linear impact tool are selected conventionally for light weight, for compatibility with the environment (air or seawater) and for long service life. In making a version for undersea use, the nonmoving parts exposed to seawater are preferably either 300 series stainless steel or hard anodized 6061-T6 aluminum. The housings are preferably aluminum and the fasteners and some of the smaller external parts are preferably stainless steel. To withstand impact stresses, the striker and mating parts are preferably case hardened steel and, in addition, the striker may be hard chromium plated where it is exposed to sea water.

OPERATION OF THE TOOL

The tool has two modes of operation; continuous cycling and single blow. The mode is selected by the mode selector 38 shown in FIGS. 6 and 8. In the position shown, the selector will allow the tool to continue to cycle as long as the trigger is held depressed. In the other position of the mode selector the striker is cocked by squeezing the trigger and then the blow is delivered when the trigger is released. Thus, single, heavy, accurately-placed blows can easily be struck.

Figure 2:
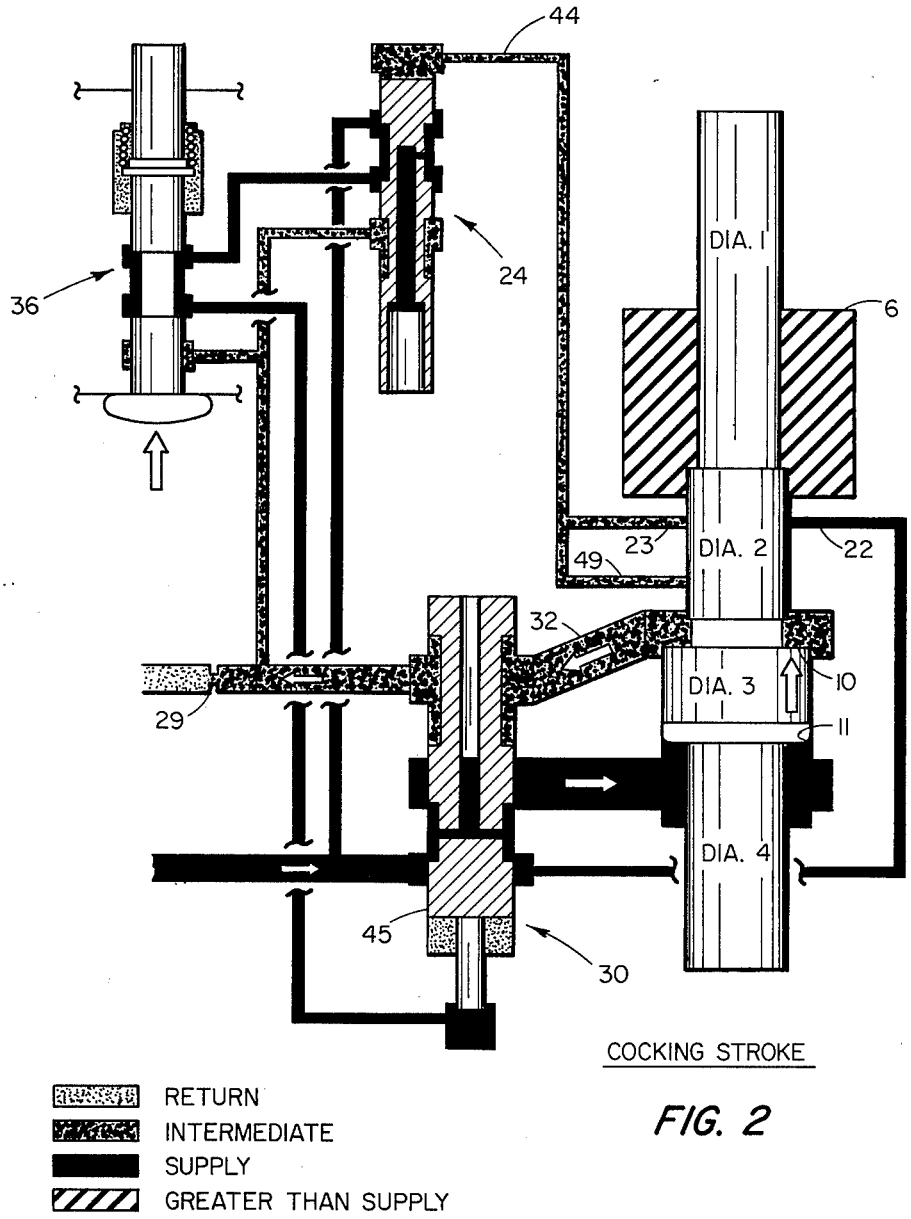
FIG. 2 is a schematic of the device of FIG. 1 showing the cocking stroke after the trigger is actuated.
Figure 3:
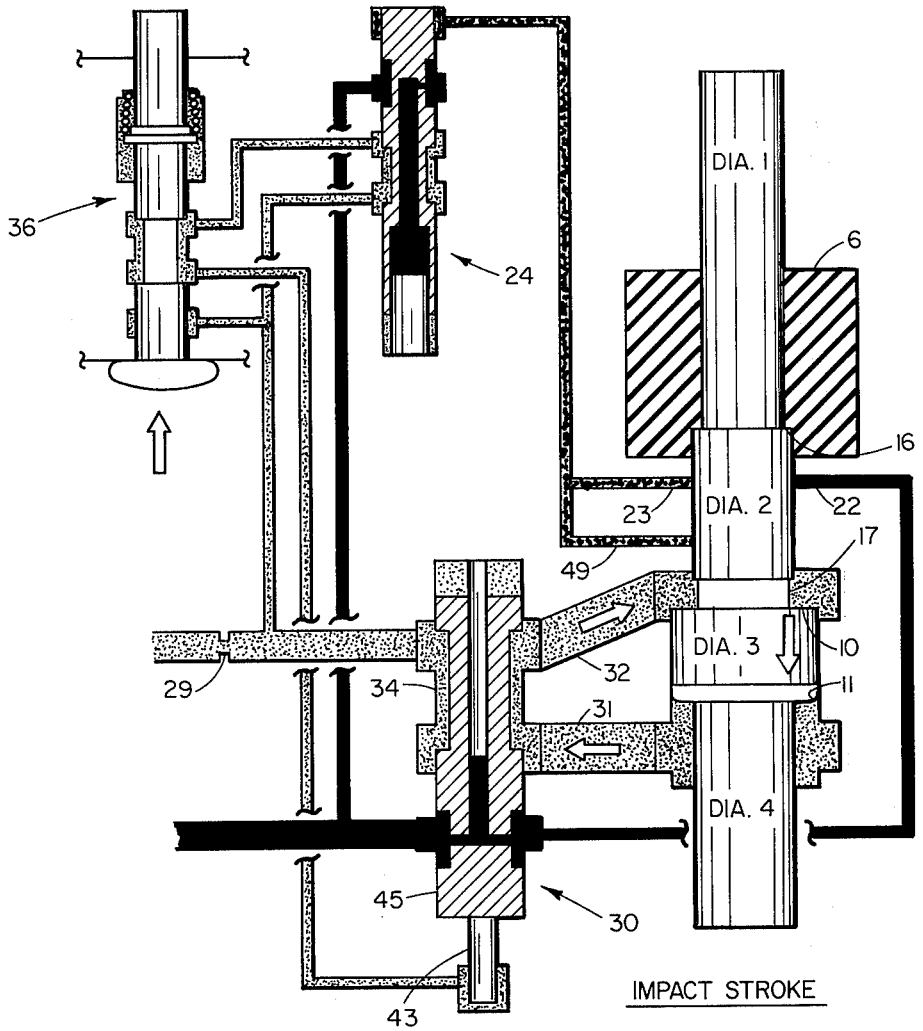
FIG. 3 is a schematic of the device of FIG. 1 showing the impact stroke.
Figure 4:
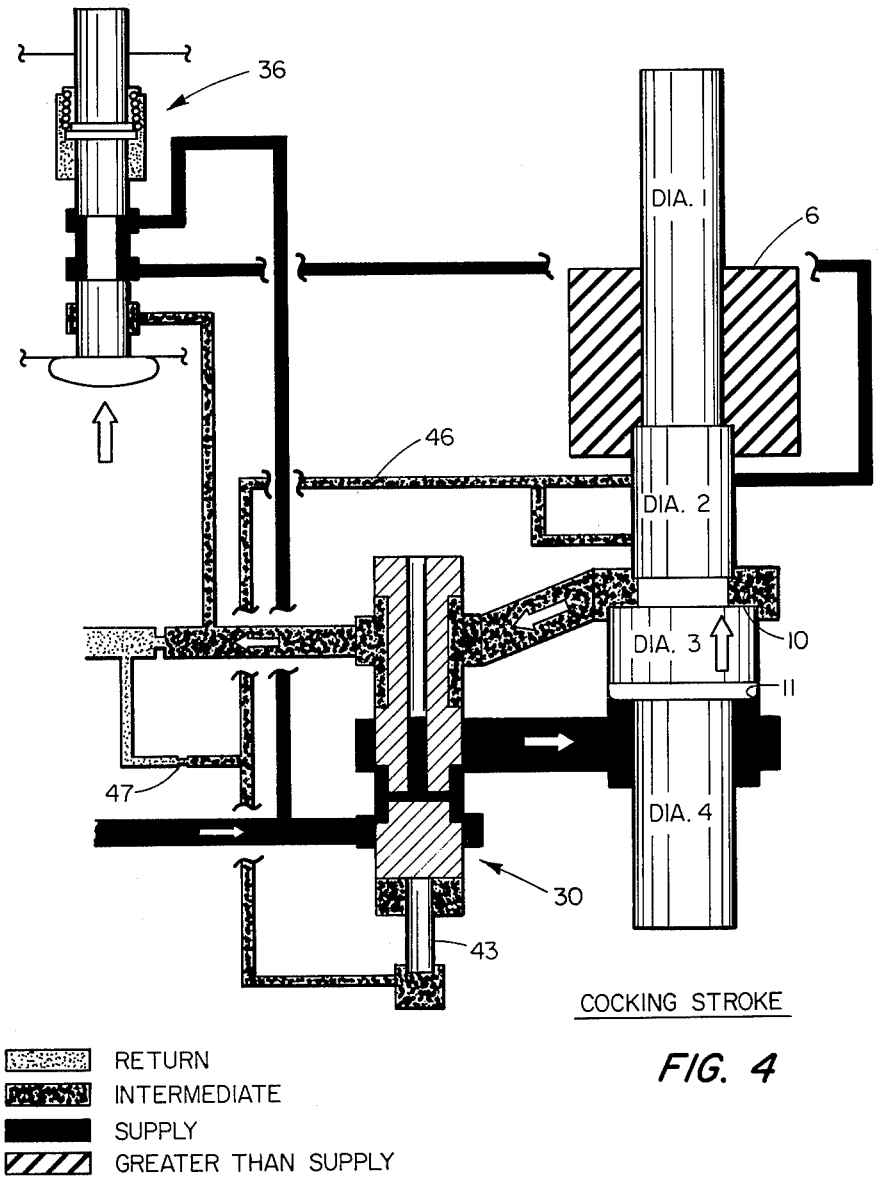
FIG. 4 is a schematic drawing of an alternative embodiment of the hydraulic impact device wherein the pilot valve is omitted and showing the cocking stroke details.
Figure 5:
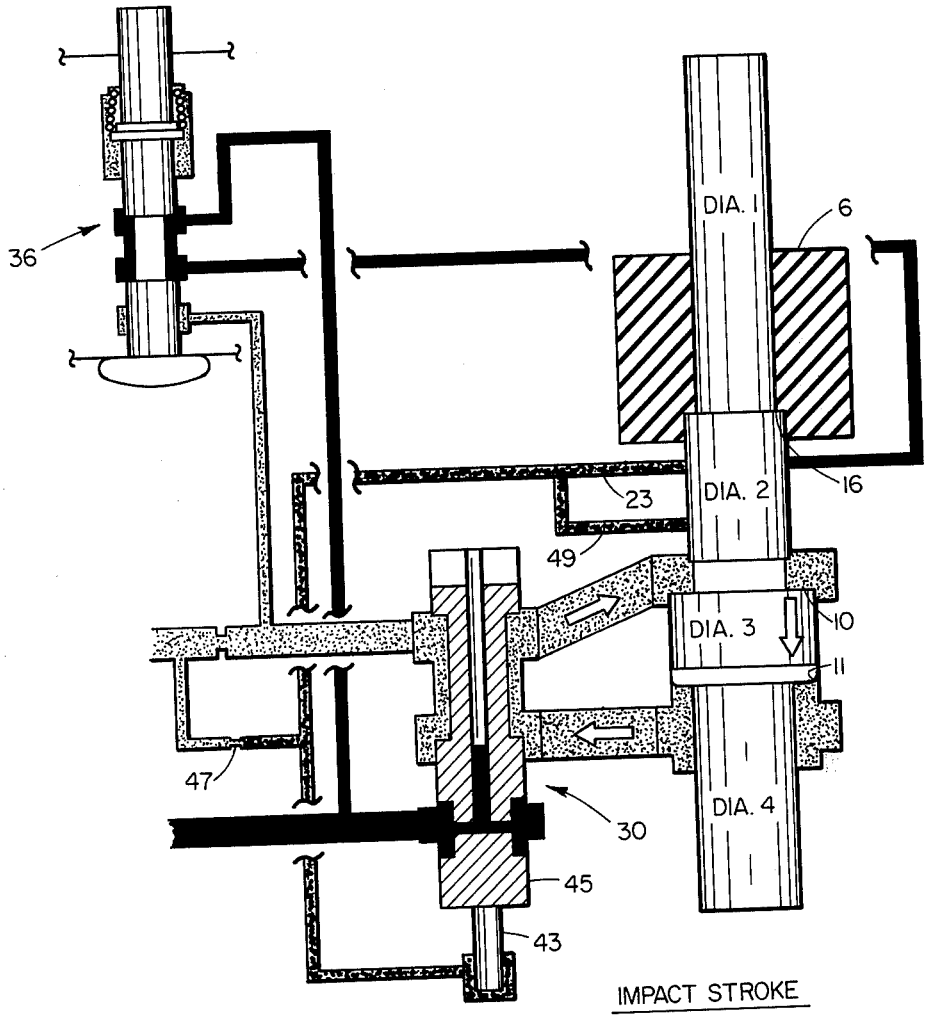
FIG. 5 is a schematic of the alternative device of FIG. 4 showing the impact stroke.
Figure 6:
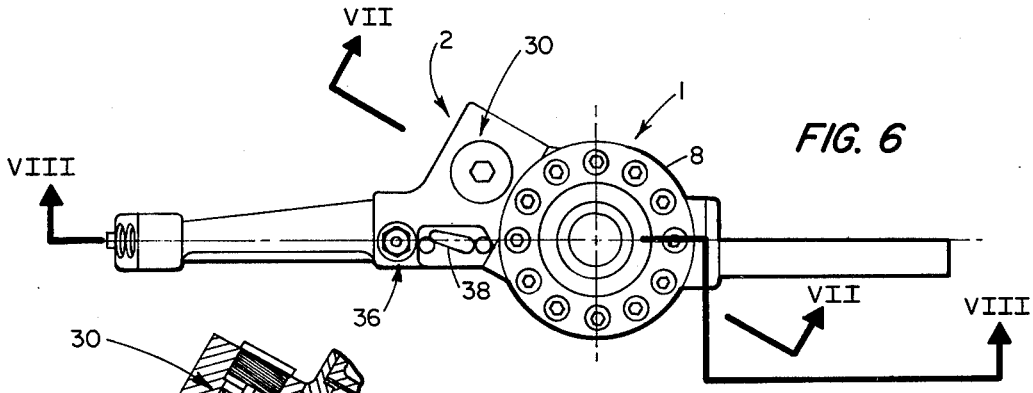
FIG. 6 is a top view of a hydraulic linear impact device employing the invention.

The tool can function with the pilot valve as shown in FIGS. 1–3 or without the pilot valve as shown in FIGS. 4 and 5. Preferably, the pilot valve is used because it provides positive control for the single-blow mode and provides much better control response for delivering multiple blows when operating in the continuous mode.

The functional operation of the linear impact tool and additional elements of its construction may be envisioned by referring to the operating sequence shown schematically in FIGS. 1, 2 and 3 and to the following discussion. The striker 5 is a plunger which extends through the tool and reciprocates to deliver impact blows to any tool bit in the chuck. The striker has several diameters that form annular areas therebetween on which hydraulic fluid acts to cause reciprocation in a unique manner. One annular area (the return annulus 10 between Diameters 2 and 3 which are separated by a groove 17) is connected to low pressure fluid in the return line. An opposed annular area (the valved annulus 11 between Diameters 3 and 4) is alternately valved to higher-pressure fluid in the supply line during the cocking stroke and to the lower-pressure return line during the impact stroke. A third smaller annular area (the spring annulus 16 between Diameters 1 and 2) works in conjunction with the valving flutes 28 to enclose a volume of hydraulic fluid within the spring chamber 6 which acts as a hydraulic spring when powering the striker on the impact stroke.

The action of the striker is controlled by three valves; (1) a large main valve 30 that alternately connects the striker valved annulus 11 to supply the return pressure, (2) a small pilot valve 24 that controls the main valve and (3) a trigger valve 36 that gives the operator on-off control of the tool.

As shown in FIGS. 1–3 the main valve spool 45 is urged downward by a small plunger 33 which is always connected to supply pressure. The position of the main valve is then controlled by a larger plunger 43 which is connected to either the supply or return pressures through the trigger and pilot valves. The pilot valve spool 25 is urged upward by a plunger which is always connected to supply pressure. The position of the pilot valve is controlled by pressure acting on the upper end of the pilot valve spool 25 which is connected to either the supply or return pressure by the valving flutes 28 (see FIG. 10) on the striker and the ports 23 and 49 at Diameter 2. The trigger valve is urged downward by a mechanical spring which is overcome when an operator actuates the trigger. The striker valving involves the interaction of the flutes 28 between Diameters 1 and 2 and the groove 17 between Diameters 2 and 3 with the ports 22, 23, 49 which connect to Diameter 2 (the porting consists of 4 pairs of holes for pressure balance as shown in FIGS. 9 and 10).

FIG. 1 shows the status of all elements in the tool after the trigger is released (after impact) and there are normal hydraulic pressures in the supply and return lines. With the trigger released, (1) the trigger valve 36 connects the large plunger 43 on the main valve 30 to return pressure, (so the small plunger 33 urges the valve downward), (2) the main valve connects the valved annulus 11 and return annulus 10 on the striker to return pressure, (3) supply pressure acts on the spring annulus 16 of the striker (urging the striker downward), and (4) supply pressure acts through striker valving flutes 28 to urge the pilot-valve spool downward. The status of the tool shown in FIG. 1 is a stable condition. None of the parts will move from the positions shown (unless the trigger is actuated) regardless of how supply or return pressures may change. Also, regardless of the status of the tool, if there are normal supply and return pressures the elements will return to the positions shown in FIG. 1 following the release of the trigger.

FIG. 2 shows the status of the tool elements somewhat after trigger actuation when the striker is well into the cocking stroke. The trigger valve 36 has connected the large main-valve plunger 43 to supply pressure (through the pilot valve), which caused the main valve spool 45 to move upward and connect supply pressure to the valved annulus 11 of the striker. The striker is moving upward causing intermediate pressure in the main return port 32 due to flow resistance of return orifice 29 and is at a position where valving action has occurred at the flutes 28 between Diameters 1 and 2. The tool bit in contact with a workpiece is moved to impact position (shouldered against the chuck) through motion of the linear impact tool initiated by the operator. Return orifice 29 causes higher initial pressure during the cocking and thus greater energy storage and impact velocity, however it is not necessary for functional operation.

The valving action of the striker flutes 28 between Diameters 1 and 2 has occurred as follows: (1) the pilot valve line 44 was disconnected from supply pressure and closed to hold the pilot valve spool in the down position, and (2) the spring chamber 6 was disconnected from supply pressure and closed to trap the fluid. As the striker 5 moves upward after valving takes place, the pressure in the spring chamber increases due to compression of the hydraulic fluid as a function of the area of the spring annulus 16, the stroke, and the effective bulk modulus of the fluid and chamber. The area of the striker valved annulus 11 is several times the spring annulus 16 so there is the potential for significant pressure increase in the spring chamber.

FIG. 3 shows the status of the tool elements during the impact stroke while operating in the automatic mode. Striker motion reversal at the end of the cocking stroke occurs when the striker groove 17 between Diameters 2 and 3 moves up far enough to uncover the port 49 which connects the end of the pilot valve to return pressure. This causes (1) the pilot valve spool 25 to shift upward, (2) the large plunger 43 on the main valve to be connected to return pressure, (3) the main valve spool 45 to shift downward, (4) the connection of the striker valved annulus 11 to return pressure, and (5) reversal of striker motion due to high pressure acting on the spring annulus 16. The striker is accelerated throughout the impact stroke until the tool bit is struck and energy is delivered to the work.

Just before impact, the striker valving flutes 28 between Diameters 1 and 2 connect supply pressure to the spring chamber and to the end of the pilot valve spool 25 which causes: (1) the pilot valve spool to shift downward, (2) the connection of the large plunger 43 on the main valve 30 to supply pressure, (3) the main valve spool 45 to shift upward, and (4) the connection of supply pressure to the striker valved annulus 11. Since the striker is traveling at high velocity when this chain of events is initiated, impact occurs before the main valve spool starts to move.

When automatic mode is selected, the tool will continue to cycle as described above and as shown in FIGS. 2 and 3, as long as the trigger is held down. If the single-blow mode is selected using the mode selector 38, the pilot valve spool 25 is constrainted to the down position as shown in FIGS. 1 and 2 and the cocking stroke occurs as described above. After the tool is cocked, the operator initiates the impact stroke by releasing the trigger causing (1) connection of the main-valve large plunger 43 to return pressure, (2) shift of the main valve spool 45 downward, (3) connection of the striker valved annulus 11 to return pressure, and (4) motion of the striker downward as urged by high pressure acting on the striker spring annulus 16. Since the pilot valve is prevented from acting, the striker delivers the impact blow and comes to rest in the overtravel position shown in FIG. 1.

If operation of the device without the pilot valve is desired, the operation is generally the same but without the degree of timing control and control response provided with the pilot valve. Although single blow operation is not easily accomplished, continuous cycling is comparable to operation with the pilot valve. The tool is stable with the elements in positions shown in FIG. 1, however, the spring cavity is temporarily at return pressure instead of supply pressure. As the trigger is depressed, the cocking stroke proceeds, and as shown in FIG. 4, the trigger valve 36 has connected the spring chamber 6 and the large main-valve plunger 43 to supply pressure which caused the main valve spool 45 to move upward and connect supply pressure to the valved annulus 11 of the striker. The striker is moving up and is at a position where valving action has occurred at the flutes 28 between Diameters 1 and 2.

The valving action of the striker flutes 28 between Diameters 1 and 2 has occurred as follows: (1) the main valve line 46 was disconnected from supply pressure and closed to hold the main valve at intermediate pressure in the up position, and (2) the spring chamber was disconnected from supply pressure and closed to trap the fluid.

An orifice 47 in the main valve line ensures that the tool will start reliably (although a brief time might elapse) regardless of what position the main valve spool and striker were left in when the tool was previously shut down.

FIG. 5 shows the status of the tool elements during the impact stroke while operating in the automatic mode. Striker motion reversal at the end of the cocking stroke occurs when the striker groove 17 between Diameters 2 and 3 moves up far enough to uncover the port 49 which, without the pilot valve, now connects the large plunger 43 of the main valve to return pressure. This causes (1) the main valve spool 45 to shift downward, (2) the connection of the striker valved annulus 11 to return pressure, and (3) reversal of striker motion due to high pressure acting on the spring annulus 16.

Just before impact, the striker flutes 28 between Diameters 1 and 2 connect supply pressure to the spring chamber 6 and to the large plunger 43 on the main valve, which causes the main valve to shift upward and the connection of supply pressure to the striker valved annulus 11. Since the striker is traveling at high velocity when this chain of events is initiated, impact occurs before the main valve starts to move. The tool will continue to cycle as described above and as shown in FIGS. 4 and 5, as long as the trigger is held down.

The primary advantage of the invention is that the combination of valves and annular areas on the striker eliminate flow of hydraulic fluid in the supply and return lines during the impact stroke—a feature which is beneficial to the size and life of the lines as well as performance of the tool. Smaller diameter and longer supply and return lines can be used without a loss in work output of the impact stroke. Higher velocity impact strokes may also result. The main feature which allows this advantage is the design of the main supply and return ports 31, 32 and the connecting passage 34 in the main valve formed between the main valve spool 45 and the control valve housing 2 (as best seen in FIGS. 3 and 7). As the striker 5 is forced in its downward impact stroke, the tool is in the condition shown in FIG. 3. Higher pressure fluid, which has acted on the valved annulus 11 to cock the striker, is now forced back through supply port 31 and may circle around through the connecting passage 34 in the main valve to the return port 32 and the cavity around the striker near the return annulus 10. Some of the fluid may at the same time pass to the return line through the connecting passage 34 in the main valve but it is restricted somewhat by the return orifice 29.

This important design advantage allows the striker to move forward without overcoming the inertia in the long return lines and possible cavitation in the tool as is experienced in prior art tools. The impact stroke is therefore quicker and faster.

The device can either be used in an air environment or an underwater environment to any depth. Its lightweight, ability to function efficiently at great distances from the hydraulic power supply, and its accurate single and continuous impact features are particularly important for striking heavy controlled blows in any working environment.

The hydraulic spring is preferred in the tool for supplying the impact energy to the striker, but either well-known pneumatic or mechanical compression springs can be used in its place without detracting from the other advantages of the tool design.

The relationship of Diameters 1, 2, 3 and 4 are important to the desired operation of the tool. In the preferred configuration, Diameters 2 and 4 are the same so that the area of the valved annulus 11 between Diameters 3 and 4 and the area of return annulus 10 between Diameters 2 and 3 are equal. However, other configurations are possible (but more complex), for example, in a configuration wherein the Diameter 3 is comprised of Diameter 3A and 3B, the valved annulus would then be defined by Diameters 3B and 4 and the return annulus would then be defined by Diameters 2 and 3A.

The relationship of the valved annulus 11 and spring annulus 16 is important in determining the operating pressures and stroke of the striker. Since there is a wide range of design values for the effective bulk modulus of the spring chamber and hydraulic fluid, the striker stroke, the operating pressures and the size of the striker diameters, it is recognized that the relative size of the spring annulus formed between Diameters 1 and 2 could vary considerably, even to the extent of the elimination of Diameter 1.

We claim:

1. A hydraulically-operated linear impact device comprising a body member having a longitudinal bore extending therethrough and a plunger supported in said bore, main valve means, trigger valve means, hydraulic fluid lines connecting said bore and valves with a source of hydraulic fluid, spring means acting near the upper end of said plunger and means for detachably mounting a tool member at the lower end of said body member wherein a. said trigger valve means is mounted in said body member for movement between an actuating position and a rest position;

b. said plunger is supported for reciprocating movement in said bore between a first position in which said plunger compresses the spring means at the upper end of the body member and a second position at the lower end of the body member in which said plunger may impact a tool member, and wherein said plunger has enlarged diameter area (DIA. 3) intermediate its upper and lower ends forming a valved annular work area (11) for hydraulic fluid pressure acting to move said plunger upward against said spring means;

c. said main valve means having connections to said bore and to a high-pressure supply line and a lower-pressure return line for hydraulic fluid and being positionable, when the trigger is in actuating position, in response to a condition of said plunger such that when the plunger is in its downward second position said main valve means connects fluid under high pressure from said supply line to said valved annular area of the plunger to cause the plunger to be moved upward against said spring means, and when the plunger has moved to its upward, first position against said spring means, said main valve means connects said valved annular area to lower-pressure fluid such that said spring means is unopposed by high pressure and can then move said plunger downward on the impact stroke;

d. said spring means comprises a mechanical, pneumatic or hydraulic spring which acts near the upper end of said plunger to bias the plunger downward, and wherein e. said hydraulic fluid lines are operable when the trigger is in the actuating position and said plunger is in its downward second position to provide a first fluid circuit from said high-pressure supply line to said main valve means for actuating the main valve means to connect fluid under high-pressure from said supply line to said valved annular area causing said plunger to be moved upward against said spring means and to compress said spring means, and said hydraulic fluid lines are operable when said plunger is in its upward first position to provide a second fluid circuit from said lower-pressure return line to said main valve means for actuating the main valve means to connect said valved annular surface to lower-pressure fluid causing the plunger to be moved downward to impact the tool member due to said compressed spring means acting on said plunger.

2. A hydraulically-operated linear impact device comprising a body member having a longitudinal bore extending therethrough (from an upper end to a lower end) and a plunger supported in said bore, main valve means, trigger valve means, hydraulic fluid lines connecting said bore and valve means with a source of hydraulic fluid, (hydraulic) spring means acting near the upper end of said plunger and means for detachably mounting a tool member at the lower end of said body member wherein a. said trigger valve means is mounted in said body member for movement between an actuating position and a rest position;

b. said plunger is supported for reciprocating movement in said bore between a first position in which said plunger compresses the spring means at the upper end of the body member and a second position at the lower end of the body member in which said plunger may impact a tool member, and wherein said plunger has enlarged diameter areas (DIA. 2 and DIA. 3) intermediate its upper and lower ends forming a valved annular work area (11) for hydraulic fluid pressure acting to move said plunger upward against said spring means and a spring annular work area (16) for hydraulic fluid pressure acting to move said plunger downward to impact said tool member;

c. said main valve means having connections to said bore, said trigger valve means and to a high-pressure supply line and a lower-pressure return line for hydraulic fluid and being positionable, when the trigger is in actuating position, in response to a condition of said plunger such that when the plunger is in its downward second position, said main valve means connects fluid under high-pressure from said supply line with said valved annular area of the plunger to cause the plunger to be moved upward against said spring means, and when the plunger has moved to its uppermost, first position against said spring means, said main valve means connects the valved annular surface to lower-pressure fluid such that said spring means is unopposed by high-pressure and can then move said plunger downward on the impact stroke;

d. said hydraulic spring means comprises an enclosed volume at the upper end of the plunger bore which is filled with hydraulic fluid, sealed against fluid loss, and the fluid compressed by reducing the enclosed volume due to movement of the plunger upward within the enclosed volume to its first position, whereby the compressed fluid may act on the spring annular area; and wherein e. said hydraulic fluid lines are operable when the trigger is in the actuating position and said plunger is in its downward, second position to provide a first fluid circuit from said high-pressure supply line to said spring means for filling said enclosed volume and to said main valve means for actuating the main valve means to connect fluid under high-pressure from said supply line to the valved annular area causing said plunger to be moved upward against said spring means and to seal the enclosed volume and compress the hydraulic fluid in said enclosed volume of said spring means, and said hydraulic fluid lines are operable when said plunger is in its upward, first position to provide a second fluid circuit from said lower-pressure return line to said main valve means for actuating the main valve means to connect said valved annular surface to lower-pressure fluid causing the plunger to be moved downward to impact the tool member due to hydraulic fluid pressure in said spring means acting on said spring annular work area.

3. The impact device of claim 1 or 2 which further comprises pilot valve means for sensing the condition of said plunger and controlling the position of said main valve means wherein said pilot valve means is mounted for movement between first and second positions in response to a condition of said plunger such that when the trigger valve means is actuated and the plunger is in its downward second position said pilot valve means, in its second position, positions said main valve means to cause the plunger to be moved upward against the spring means, and when the plunger is in its upward, first position against said spring means said pilot valve means in its first position, positions said main valve means to allow the plunger to move in its downward impact stroke.

4. The impact device of claim 3 for striking single blows or continuous blows which further comprises a mode selector associated with said pilot valve means for allowing, in a first mode, continuous operation as provided in claim 3, and in a second mode, single blow operation wherein the mode selector comprises a means for selectively, temporarily holding said pilot valve means in its downward second position which upon actuation of said trigger valve means positions said main valve means to cause the plunger to be moved upward against said spring means, and when the trigger valve means is released to return to its unactuated position said pilot valve allows said main valve means to change positions and allow the plunger to move in its downward impact stroke.

5. The impact device of claim 1 or 2 in which flow and pressure in said return line are reduced during the impact stroke wherein said enlarged diameter area (DIA. 3) of said plunger also forms a return annular work area (10) opposed to said valved annular area, and said main valve means has connections to said bore and between said valved annular area and said return annular area such that when said plunger has moved to its upward, first position against said spring means said main valve connects the fluid under high pressure acting on said valved annular area to lower-pressure fluid acting on said return annular area.

* * * * *

UNITED STATES PATENT OFFICE

CERTIFICATE OF CORRECTION

PATENT NO. : 4,314,612

DATED : 2/9/82

INVENTOR(S) : David L. Thomas and Donald J. Hackman

It is certified that error appears in the above-identified patent and that said Letters Patent are hereby corrected as shown below:

Column 1, line 19, "effected," should read -- affected, --

Column 2, line 14, "with" should read -- when --

Column 3, line 27, "AA" should read -- VII-VII --

Column 3, line 29, "BB" should read -- VIII-VIII --

Column 3, line 31, "DD" should read -- IX-IX --

Column 3, line 38, "CC" should read -- X-X --

Column 6, line 17, "the" should read -- and --

Column 10, line 8, "to" should read -- with --

Signed and Sealed this

*Eighth* Day of *June 1982*

[SEAL]

*Attest:*

GERALD J. MOSSINGHOFF

*Attesting Officer*

*Commissioner of Patents and Trademarks*

Disclaimer 4,314,612.—*David L. Thomas* and *Donald J. Hackman,* Columbus, Ohio. HYDRAULIC LINEAR IMPACT TOOL. Patent dated Feb. 9, 1982. Disclaimer filed Jan. 31, 1983, by the assignee, *Battelle Development Corp.*

Hereby enters this disclaimer to all claims of said patent.

[*Official Gazette April 19, 1983.*]